US005655890A

United States Patent [19]

Liao

[11] Patent Number: 5,655,890

[45] Date of Patent: Aug. 12, 1997

[54] TOY PUMP DEVICE

[76] Inventor: Kuo-Hua Liao, 1570 Chung San Road, Shern Gang Village, Taichung Shien, Taiwan

[21] Appl. No.: 671,177

[22] Filed: Jun. 27, 1996

[51] Int. Cl.[6] ..... F04B 9/14

[52] U.S. Cl. ..... 417/234; 417/437; 417/553; 417/569

[58] Field of Search ..... 417/234, 437, 417/553, 566, 569

[56] References Cited

U.S. PATENT DOCUMENTS

| | | | |
|---|---|---|---|
| 1,263,299 | 4/1918 | Wemhoener | 417/569 |
| 5,476,372 | 12/1995 | Yang | 417/553 |
| 5,533,879 | 7/1996 | Chen | 417/553 |

FOREIGN PATENT DOCUMENTS

| | | | |
|---|---|---|---|
| 59-39981 | 3/1984 | Japan | 417/553 |
| 289962 | 10/1928 | United Kingdom | 417/569 |

*Primary Examiner*—Michael Koczo
*Assistant Examiner*—Roland G. McAndrews, Jr.
*Attorney, Agent, or Firm*—Charles E. Baxley, Esq.

[57] ABSTRACT

A toy pump device includes a tube in which a piston rod is slidably received, a piston connected to an end of the piston rod, the piston having a tubular portion extending therefrom with a first slot defined therein and a seal slidably mounted to the tubular portion, the tube having a protrusion extending therefrom so as to have a head mounted thereto which has a hollow tube, a member slidably received between the head and the protrusion wherein an inner tube extends from an inner periphery of the head and a second slot defined in the inner tube such that when pushing the piston rod, air enters into the hollow tube via a top hole defined in the end having the head mounted thereto and the second slot to inflate a balloon mounted to the hollow tube, and when pulling the piston rod, the member closes the top hole such that the pressurized air in the balloon is avoided from leaking.

1 Claim, 6 Drawing Sheets

TOY PUMP DEVICE

BACKGROUND OF THE INVENTION

1. Field of the Invention

The present invention relates to a toy pump device and more particularly, to a toy air pump which can be used to inflate a balloon or to blow soap bubbles.

2. Brief Description of the Prior Art

Generally, children like to play balloons which are inflated by using a pump. However, if a child wants to inflate a balloon by himself/herself, he/she will find that he/she cannot provide sufficient pressured air to inflate the balloon, because the pressure needed will be gradually increased in order to overcome the pressure existing in the balloon. In fact, for an adult, to inflate a balloon is difficult, especially for inflating a big balloon.

The present invention intends to provide a toy pump device to easily inflate a balloon to mitigate and/or obviate the above-mentioned problems.

SUMMARY OF THE INVENTION

The present invention provides a toy pump device which includes a tube having an open end and a protrusion extending from the other end, the protrusion having a first passage defined longitudinally therein, the first passage communicating with a top hole defined in the end.

A piston rod has an end with a piston fixedly disposed thereto and the other end thereof connected to a disk which has a handle connected thereto. The piston has a tubular portion extending therefrom, a first flange extending radially from the tubular portion and at least one first slot defined in the tubular portion and located between the first flange and the piston. A seal is slidably disposed to the tubular portion and is located between the first flange and the piston, the seal having an outer periphery contacting an inner periphery of the tube and an inner diameter thereof being larger than an outer diameter of the tubular portion.

A head has a first end being a skirt portion which is mounted to the protrusion of the tube, a second end of the head having a hollow tube extending from the skirt, portion and an inner tube extending from an inner periphery of the skirt portion wherein the inner tube having at least one second slot defined in a periphery thereof. A member is slidably received between the protrusion and the inner tube such that the member is engaged with the inner tube when pushing the piston rod, and air enters into the hollow tube via the second slot to inflate a balloon mounted to the hollow tube. The member leaves from the inner tube and close the top hole of the tube when pulling the piston rod such that the pressured air in the balloon is avoided from leaking.

It is an object of the present invention to provide a toy pump device for a user to inflate a balloon easily.

It is another object of the present invention to provide a toy pump device which is easy to blow soap bubbles.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
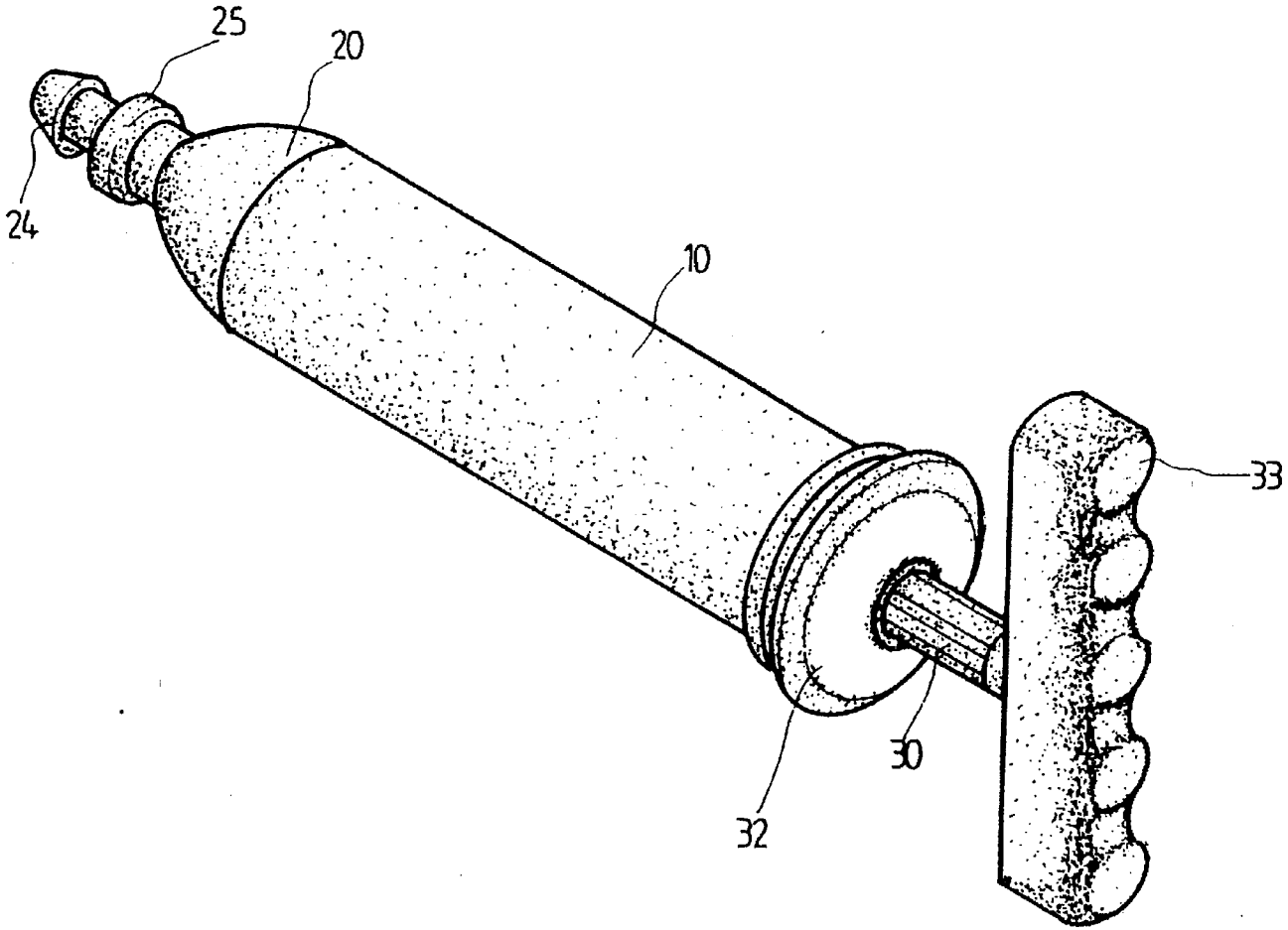
FIG. 1 is a perspective view of a toy pump device in accordance with the present invention.
Figure 2:
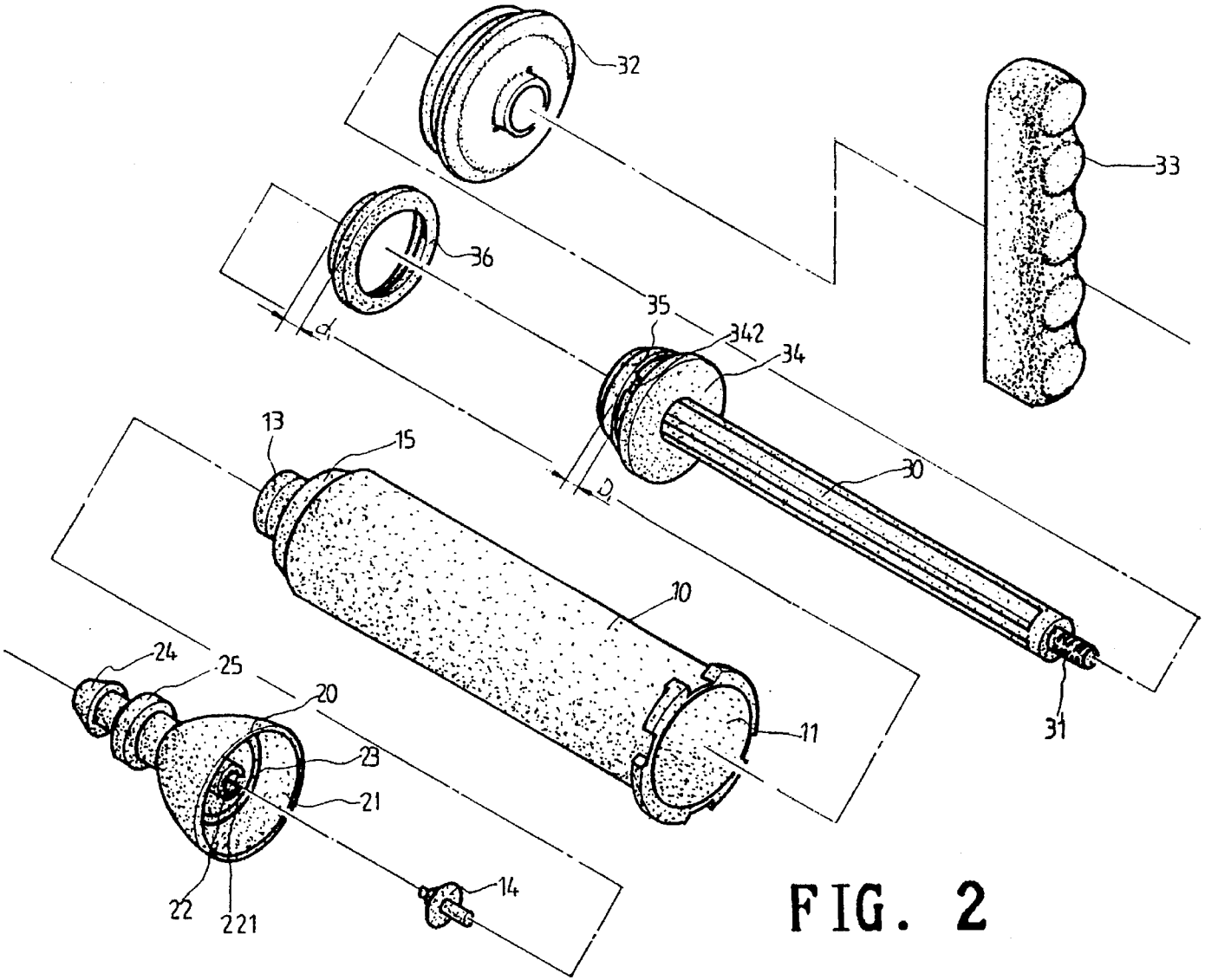
FIG. 2 is an exploded view of the toy pump device in accordance with the present invention.

Referring to the drawings and initially to FIGS. 1 through 4, a toy pump device in accordance with the present invention generally includes a tube 10 having a first end and a second end, the first end thereof being an open end 11 and the second end thereof having a first protrusion 15 extending therefrom which has a top hole 151 defined centrally therein, a second protrusion 13 extending from the first protrusion 15 wherein a first passage 131 defined longitudinally therein. The first passage 131 communicates with the top hole 151 of the first protrusion 15.

A piston rod 30 has an end with a piston 34 fixedly disposed thereto and the other end thereof is a threaded rod 31, the piston rod 30 extending through a disk 32 and the threaded rod 31 is connected to a handle 33 wherein the disk closes the open end 11 of the tube 10. The piston 34 has a tubular portion 341 extending therefrom, a first flange 35 extending radially from the tubular portion 341. At least one first slot 342 is defined in the peripheral surface of the tubular portion 341 and is located between the first flange 35 and the piston 34.

Figure 4:
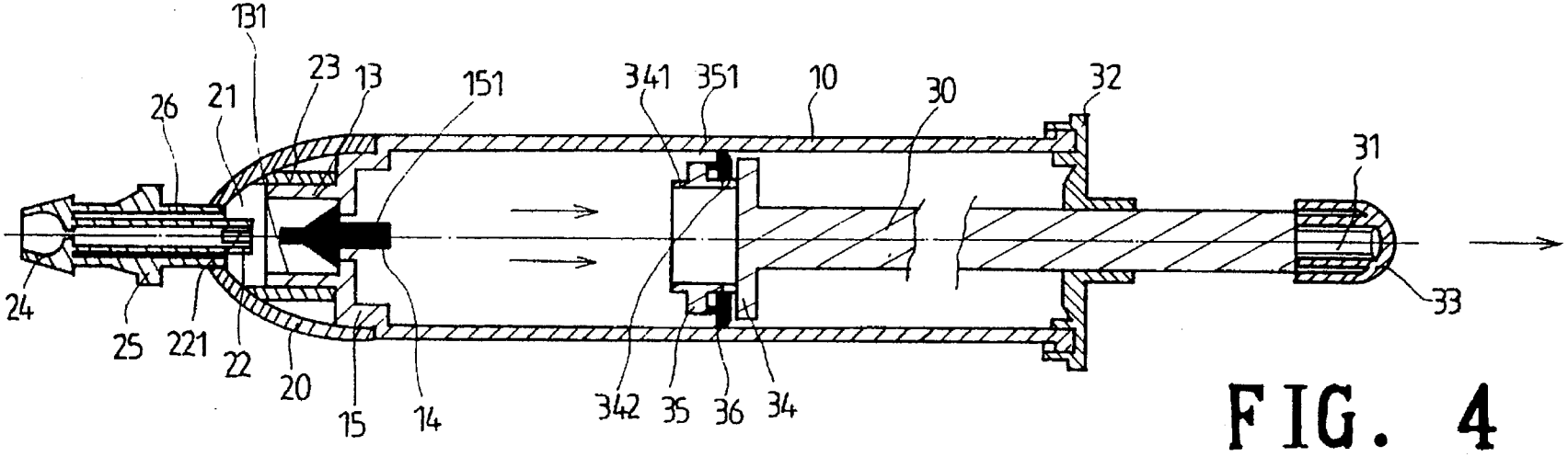
FIG. 4 is a side elevational view, partly in section, of the toy pump device when the a piston rod thereof is pulled within the tube.

A seal 36 is slidably disposed to the tubular portion 341 and is located between the first flange 35 and the piston 34. The seal 36 has an outer periphery contacting an inner periphery of the tube 10 and an inner diameter of the seal 36 is larger than an outer diameter of the tubular portion 341 such that the seal 36 can sealing closed an annular gap 351 defined between the inner periphery, of the tube 10 and the outer periphery of the first flange 35 when pulling the piston rod 30 as shown in FIG. 4. The annular gap 351 is opened when the piston rod 30 is pushed such that the seal 36 is forced to contact against the piston 34 as shown in FIG. 3.

A head 20 having a first end to be a first skirt portion 21 which is mounted to the first protrusion 15 of the tube 20, a second skirt portion 23 extending from an inner periphery of the first skirt 21 so as to mount to the second protrusion 23. A second end of the head 20 has a hollow tube 26 extending from the first skirt portion 21 and an inner tube 22 extends from the inner periphery of the first skirt portion 21. The inner tube 22 has at least one second slot 221 defined in a periphery thereof.

A member 14 is slidably received in the second protrusion 13 and is located between the inner tube 22 and the first protrusion 15 in which the top hole 151 is defined. The member 14 has a tapered outer periphery which is engaged with the inner tube 22 when pushing the piston rod 30 toward the first protrusion 15. In the stroke of pushing the piston rod 30 toward the first protrusion 15, air enters into the first passage 131 via the top hole 151 and an annular gap between the tapered outer periphery and the inner periphery of the first passage 131 and, enters into hollow tube 26 via the second slot 221. The member 14 leaves from the inner tube 22 and closes the top hole 151 of the first protrusion 15 when pulling the piston rod 30 away from the first protrusion 15.

Figure 3:
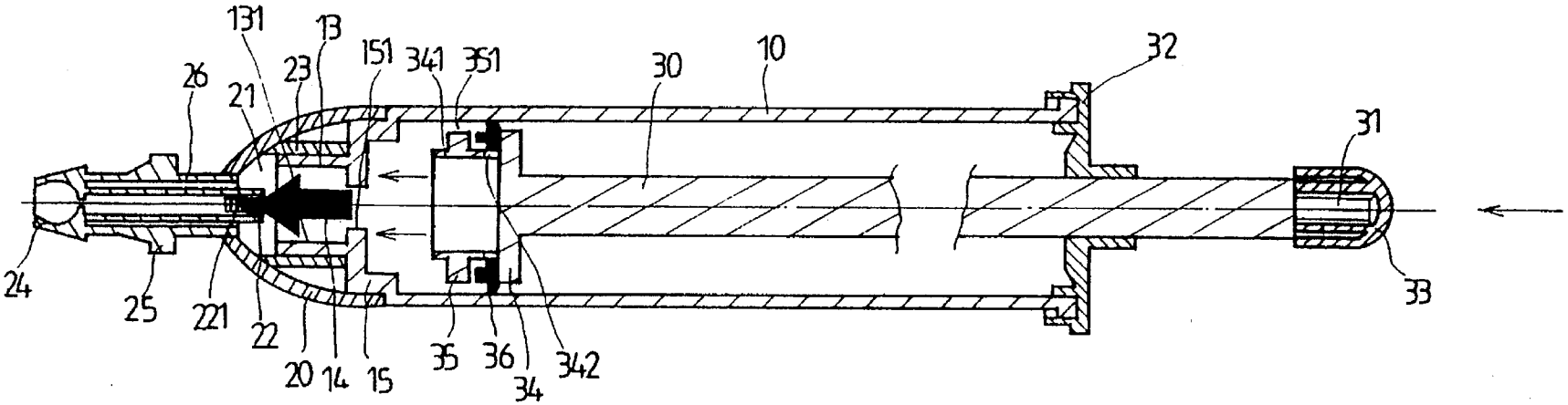
FIG. 3 is a side elevational view, partly in section, of the toy pump device when the a piston rod thereof is pushed into a tube.
Figure 5:
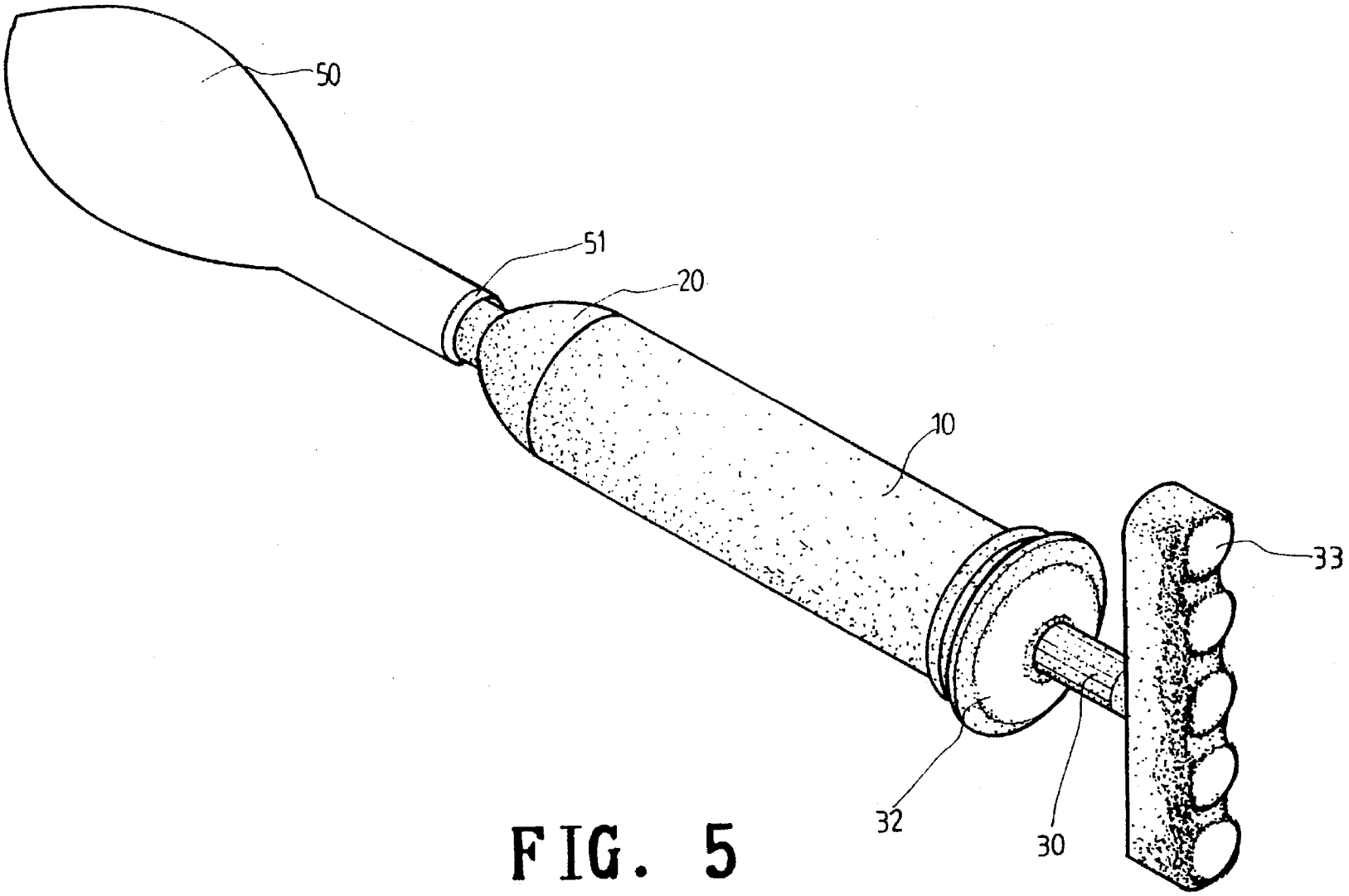
FIG. 5 is a perspective view of the toy pump device wherein a balloon is mounted thereto.

Referring to FIGS. 3 through 5, air existing in the tube 10 and located between the piston 34 and the head 20 can enter into the hollow tube 26 via the second slot 221 to inflate a balloon 50 mounted to a second flange 24 or a third flange 25 extending radially from the hollow tube 26. On the contrary, when pulling the piston rod 30 away from the first protrusion 15, the top hole 151 is closed by the member 14 and the annular gap 351 is closed by the seal 36 such that air flows into the space between the piston 34 and the first protrusion 15 via the slot 342 to facilitate the pulling of the piston red 30 and the pressurized air existing in the balloon 50 is avoided from leaking.

Figure 6:
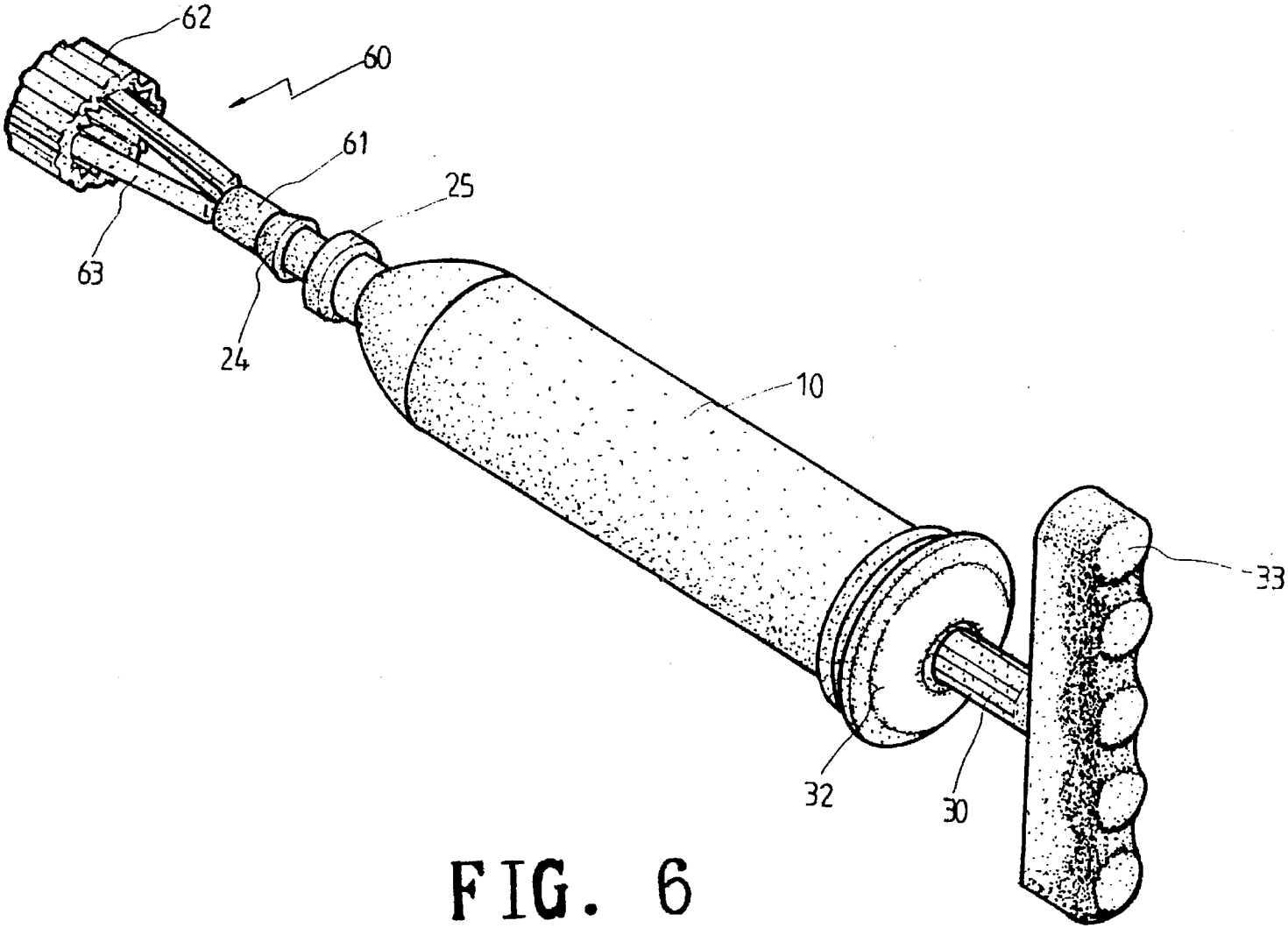
FIG. 6 is a perspective view of the toy pump device to which a bubble blower head is mounted.
Figure 7:
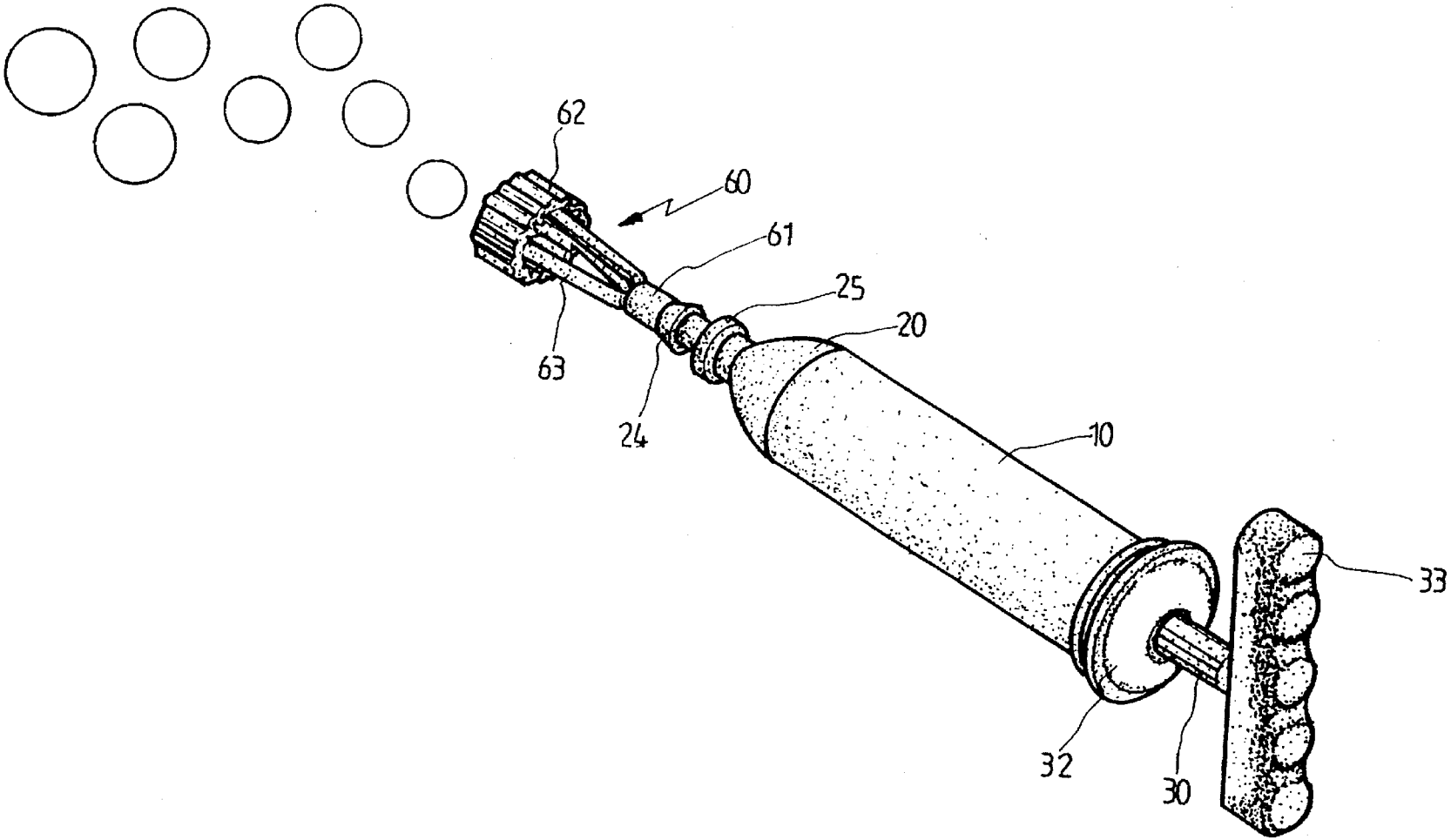
FIG. 7 is an illustrative view to show the toy pump device used as a soap bubble blower.

Referring to FIGS. 6 and 7, a bubble blower head 60 can be mounted to a distal end of the hollow tube 26, the bubble blower head 60 having an engaging portion 61 disposed to an end thereof for being engaged to the distal end of the hollow tube 26, three links 63 extending from the engaging portion 61 and a bubble producer 62 connected to the links 63 such that when pushing the piston rod 30 toward the first protrusion 15, the pump can be used as a soap bubbles blower.

Although the invention has been explained in relation to its preferred embodiment, it is to be understood that many other possible modifications and variations can be made without departing from the spirit and scope of the invention as hereinafter claimed.

What is claimed is:

1. A toy pump device comprising:

a tube having a first end and a second end, said first end thereof being an open end and said second end thereof having a protrusion extending therefrom which has a first passage defined longitudinally therein, said first passage communicating with a top hole defined in said second end of said tube;

a piston rod having an end with a piston fixedly disposed thereto and the other end thereof extending through a disk which closes said open end of said tube, said piston having a tubular portion extending therefrom, a first flange extending radially from said tubular portion and at least one first slot defined in said peripheral surface of said tubular portion and located between said first flange and said piston;

a seal slidably disposed to said tubular portion and located between said first flange and said piston, said seal having an outer periphery contacting an inner periphery of said tube and an inner diameter of said seal being larger than an outer diameter of said tubular portion;

a head having a first end being a skirt portion which is mounted to said protrusion of said tube, a second end of said head having a hollow tube extending from said skirt portion and an inner tube extending from an inner periphery of said skirt portion wherein said inner tube having at least one second slot defined in a periphery thereof, said inner tube communicating with said hollow tube, and a member slidably received between said protrusion and said inner tube such that said member is engaged with said inner tube when pushing said piston rod toward said first protrusion, and air enters into said hollow tube via said second slot, said member leaving from said inner tube and closing said top hole of said tube when pulling said piston rod away from said first protrusion.

* * * * *